US011670888B2

(12) United States Patent
Johnston

(10) Patent No.: US 11,670,888 B2
(45) Date of Patent: Jun. 6, 2023

(54) TELESCOPING ELECTRICAL RECEPTACLE

(71) Applicant: Nathan Johnston, Timmins (CA)

(72) Inventor: Nathan Johnston, Timmins (CA)

( * ) Notice: Subject to any disclaimer, the term of this patent is extended or adjusted under 35 U.S.C. 154(b) by 0 days.

(21) Appl. No.: 17/346,773

(22) Filed: Jun. 14, 2021

(65) Prior Publication Data

US 2022/0077622 A1 Mar. 10, 2022

Related U.S. Application Data

(60) Provisional application No. 63/074,507, filed on Sep. 4, 2020.

(51) Int. Cl.

| | |
|---|---|
| ***H01R 27/02*** | (2006.01) |
| ***H01R 13/514*** | (2006.01) |
| ***H01R 13/717*** | (2006.01) |

(52) U.S. Cl.

CPC ..... *H01R 13/514* (2013.01); *H01R 13/717* (2013.01); *H01R 27/02* (2013.01)

(58) Field of Classification Search

CPC .... H01R 13/514; H01R 13/717; H01R 27/02; H01R 25/006; H01R 24/76; H01R 24/78; H01R 31/06; H01R 35/02; H01R 24/66; H02G 3/14

See application file for complete search history.

(56) References Cited

U.S. PATENT DOCUMENTS

| | | | | |
|---|---|---|---|---|
| 7,393,250 | B2 * | 7/2008 | Tanaka | H01R 25/003 439/652 |
| 7,544,100 | B2 * | 6/2009 | Teitelbaum | H01R 13/652 439/652 |
| 9,551,454 | B2 * | 1/2017 | Lipke | F16M 13/02 |
| 9,831,622 | B1 * | 11/2017 | Lin | H01R 29/00 |
| 10,199,783 | B2 * | 2/2019 | Finn | H01R 13/629 |
| 11,303,080 | B2 * | 4/2022 | Tsang | H01R 27/00 |
| 11,381,046 | B2 * | 7/2022 | Greer | H01R 31/02 |
| 2004/0209514 | A1 * | 10/2004 | Marshall Yoe | H01R 25/006 439/529 |
| 2021/0210915 | A1 * | 7/2021 | Galazin | H01R 13/6691 |

* cited by examiner

*Primary Examiner* — Tho D Ta

(74) *Attorney, Agent, or Firm* — Brennan, Manna & Diamond, LLC

(57) ABSTRACT

This present invention relates to a telescoping electrical receptacle designed to elevate the position of an electrical and/or USB receptacle for providing easier access to individuals. The telescoping electrical receptacle comprises a plurality of female receptacles on its front surface and a male plug at its rear surface that plugs the device into an existing wall outlet to provide electrical power to the device and the plurality of female receptacles on its front surface in particular. Additionally, the electrical receptacle device features one or more accordion or telescoping extension members to extend the height or length of the electrical receptacles from the all outlet.

17 Claims, 6 Drawing Sheets

TELESCOPING ELECTRICAL RECEPTACLE

CROSS-REFERENCE TO RELATED APPLICATION

The present application claims priority to, and the benefit of, U.S. Provisional Application No. 63/074,507, which was filed on Sep. 4, 2020 and is incorporated herein by reference in its entirety.

FIELD OF THE INVENTION

The present invention relates generally to the field of electrical receptacles. More specifically, the present invention relates to a uniquely designed electrical receptacle that can be raised or elevated in height to make the receptacle more accessible to individuals, especially those with disabilities and the elderly, or in situations where the receptacle or plug is difficult to reach, such as when it is behind a piece of furniture, such as a sofa, chair or table. The modified electrical receptacle device is a raised wall outlet receptacle that comprises a male plug that plugs into the existing wall outlet, and a plurality of 15/20 amp or other female wall electrical, USB or other receptacles positioned near the top of the device. The electrical receptacle of the invention also removes potential electrical hazards away from small children by elevating the position of the receptacle out of their immediate reach. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, various types of electrical receptacles or outlets are used by people to access electrical power within a building or other similar structure. The electrical receptacle or outlet is typically a socket that connects an electrical device to an electricity supply. Usually, the electrical receptacles receive the prongs of a plug to provide electrical power access and are mounted in electrical outlet boxes within the wall of the building.

Traditional electrical receptacles or outlets are often mounted at a standard height of between 12 to 18 inches AFF (above finish floor). It may be difficult for some individuals to access the electrical receptacles or outlets mounted at such standard height. The elderly, people with disabilities or people with limited dexterity may find it too hard to access these electrical receptacles or outlets for their use. In addition, the low position of these electrical receptacles or outlets can make accessing the outlet difficult when plugging in a television or office equipment due to the receptacle often being obstructed by a piece of furniture such as a sofa, bed, office desk, and the like. By raising the electrical outlet up a sufficient height, the outlet can be more readily reached and the individual does not have to move the furniture.

Further, the electrical receptacles or outlets which are mounted on a wall or at a low height are easily accessible to small children, such as toddlers or infants that are crawling and pose a potential safety hazard for kids. Children being unaware of the risks of electrical receptacles may be electrically shocked, and are at risk for other safety hazards. Consequently, children may be injured and may potentially lose their lives due to inadvertent access to electrical receptacles.

Furthermore, there are other kinds of devices such as power bars or strips, which are used to provide electrical power supply to individuals. A power strip is a length of electrical sockets in a housing that is attached to the end of a flexible cable that plugs into an existing electrical receptacle. Any device requiring access to electrical power can be plugged into the electrical sockets of the power strip. However, such devices lead to a cluttered environment due to the presence of cords on the floor, and may lead to accidents where individuals trip on the exposed electrical cords and fall. Additionally, devices such as power cords are also available in the market to connect an appliance to the main electricity supply via a wall socket or extension cord. This also adds to the hazardous clutter on the floor, and may be unsightly due to the length of cord that is exposed. The flexible chord being comprised of a rubber sheathing poses a potential electrical hazard if cable is compromised by mechanical damage and live cabling is left exposed Therefore, there exists a long felt need in the art for electrical receptacle device that provides convenient access to an electrical power supply for various devices or equipment, and that may be repositioned to a height that is more easily accessible by an individual. Additionally, there is a long felt need in the art for an electrical receptacle or outlet device that can be conveniently accessed by the elderly and individuals with disabilities and/or limited dexterity, and thereby making an otherwise obstructed outlet more accessible. Moreover, there is a long felt need in the art for an electrical receptacle or outlet device that may be positioned at a safe height, out of the reach of small children. Further, there is a long felt need in the art for an electrical receptacle or outlet that reduces clutter and tripping hazards by eliminating the need for an extension cord. Finally, there is a long felt need in the art for an electrical receptacle or outlet device that is portable, easily mountable, relatively inexpensive to manufacture and that is both safe and easy to use.

The subject matter disclosed and claimed herein, in one embodiment thereof, comprises an electrical receptacle elevator or telescoping device designed to elevate or raise the position of an electrical receptacle for easier access. The invention comprises a generally rectangular plastic body having a front surface, a rear surface, a pair of side surfaces and, in a preferred embodiment, an accordion extension mechanism. The front surface may comprise one or more electrical receptacles, one or more USB receptacles and a push button to activate the various receptacles. The rear surface has a male plug or prong with a ninety-degree outlet swivel head. The ninety-degree outlet swivel head is configured to rotate the electrical receptacles elevator device up to ninety degrees, in order to provide flexibility in the mounting of the electrical receptacle elevator or telescoping device in a horizontal position. The male plug has two or three blades to plug into a wall receptor, and the accordion or telescoping extension mechanism raises the height of the plurality of electrical receptacles and USB receptacles disposed on at least one surface of the housing by increasing the height of the electrical receptacle elevator device from the height of the existing wall plug. The electrical receptacles elevator device also has a connector bus to transmit power from the male plug, which is in the wall, to the receptacles.

In this manner, the novel electrical receptacle of the present invention accomplishes all of the forgoing objectives, and provides a relatively safe, easy and convenient solution for providing access to electrical power supply to various appliances. The electrical receptacle of the present invention is also user friendly, inasmuch as the device is easily accessible by individuals, especially elderly people, people with disabilities, or people with limited physical dexterity. Additionally, the electrical receptacle is safe for children, and prevents them from any safety hazards due to traditional electrical receptacles or outlets.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises an electrical receptacle elevator or telescoping device designed to elevate or raise the position of supplemental electrical receptacles for easier access. The telescoping housing has a generally rectangular plastic body or housing having a front surface, a rear surface, a pair of side surfaces and an accordion extension mechanism. The front surface has one or more female electrical receptacles, at least one USB receptacle and a push button or switch to activate the receptacles. The rear surface has a male plug with a ninety-degree outlet swivel head. The ninety-degree outlet swivel head is configured to rotate the electrical receptacles elevator or telescoping device up to ninety degrees so as to be able to mount the electrical receptacles elevator device in a horizontal position. The male plug has two or three blades, one of which may be a ground prong, to plug into a wall receptor. The accordion extension mechanism raises the height of at least one of the electrical receptacles and at least one of the USB receptacles by increasing the height of the electrical receptacles elevator device above the existing wall outlet. The electrical receptacles elevator or telescoping device also has a connector bus to transmit power from the wall outlet to the receptacles.

In a further embodiment of the present invention, a wireless device may be used to raise the height of electrical receptacles is disclosed and comprises a male plug having two or three blades or prongs to plug into a wall receptor. A plurality of electrical receptors and USB receptors are provided on the housing of the telescoping device. The plurality of female receptors and the plurality of USB receptors receive electrical power from the wall outlet through an electrical current transmission. Also included is a plurality of accordion or extension members which can be stretched to variably increase the longitudinal height (or width, depending on the orientation) of the device to raise the position of the receptors and USB ports vertically above the level of wall outlet. A screw and an anchor drywall mounting device is used to mount the wireless device to a wall and a ninety-degree outlet swivel head is configured to rotate the electrical receptacles elevator or telescoping device up to ninety degrees in order to mount the electrical receptacles elevator device in a horizontal position. The wireless device raises the height of the accessibility of the original wall outlet virtually by 18" to 24" vertically via at least one accordion or telescoping extension mechanism or members.

The wireless device is designed to elevate or raise the position of an additional electrical receptacle for easier access, and provides at least one electrical receptacle that can be elevated or raised in height to improve accessibility and make the receptacles easier to access for seniors, individuals with disabilities and anyone else who desires an easier access point. The device further removes the potential electrical hazard for small children by elevating the position of the receptacles above the level of a traditional wall outlet. The device eliminates the need to use power bars and extension cords on the floor, and allows the device to be mounted vertically or horizontally on a wall or other area where an existing receptacle may be found.

The device of the present invention offers both normal female receptacles and USB receptacles or ports for charging and working any electronic or electrical device. The device is economical in cost to manufacture, is lightweight and portable, having a minimum number of components and optimizes the required amount of high cost conductive metals.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
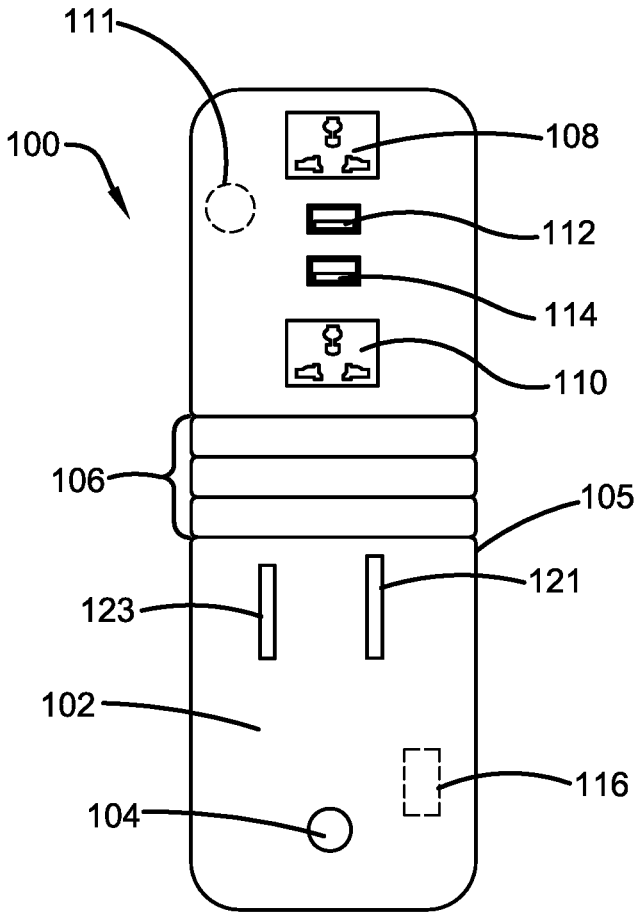
FIG. 1 illustrates a front perspective view of one potential embodiment of the electrical receptacle elevator device of the present invention in a normal or collapsed position in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for electrical receptacle device that provides convenient and easy access to an electrical power supply for various devices and/or equipment, and that may be repositioned to a height that is more easily accessible to an individual. Additionally, there is a long felt need in the art for an electrical receptacle or outlet device that can be conveniently accessed by the elderly and individuals with disabilities and/or limited dexterity, and that makes an otherwise obstructed outlet more accessible. Moreover, there is a long felt need in the art for an electrical receptacle or outlet device that may be positioned at a safe height, and out of the reach of small children. Further, there is a long felt need in the art for an electrical receptacle or outlet device that reduces clutter and tripping hazards by eliminating the need for an extension cord. Finally, there is a long felt need in the art for an electrical receptacle or outlet device that is portable, easily mountable, relatively inexpensive to manufacture, and that is both safe and easy to use.

Referring initially to the drawings, FIG. 1 illustrates a front perspective view of one potential embodiment of the electrical receptacle elevator device 100 of the present invention in a normal or collapsed position in accordance with the disclosed architecture. The electrical receptacle elevator or telescoping device 100 is a device designed to elevate or raise the position of an existing electrical wall receptacle for easier access by an individual and without having to physically relocate the existing wall receptacle. The electrical receptacle elevator or telescoping device 100 also enables a user to obtain access to an otherwise inaccessible wall outlet, and to position the same out of the reach of young children.

Figure 2:
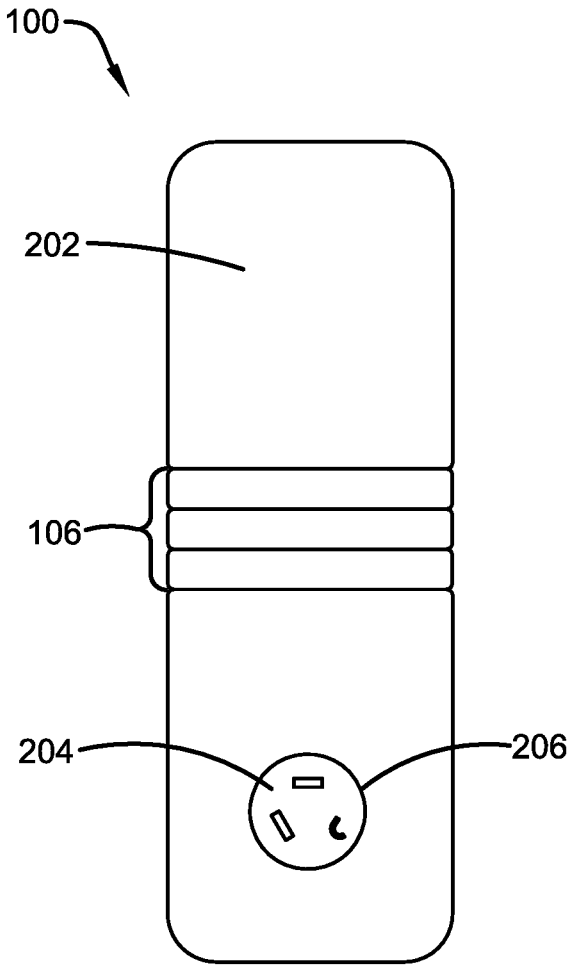
FIG. 2 illustrates a rear perspective view of one potential embodiment of the electrical receptacle elevator device of the present invention in a normal or collapsed position in accordance with the disclosed architecture.

The receptacle elevator device 100 is preferably comprised of a generally rectangular plastic body or housing having a front surface 102, a rear surface (as best shown in FIG. 2) and two side surfaces, wherein the housing has a longitudinal length that is greater than its transverse width, and further wherein the receptacles/ports of the device are positioned along a longitudinal axis of the device 100, as more fully explained below. The front surface 102 faces away from the wall upon which the receptacle elevator device 100 is mounted and towards the user. Further, the front surface 102 preferably comprises at least one (and preferably two) electrical outlet(s) 108, 110, and at least one (and preferably two) USB ports 112, 114. The electrical outlets 108, 110 may be twenty ampere female wall receptacles, but are not required to be, and it should be appreciated that other ampere values may also be present on the front surface 102 of the receptacle elevator device 100.

The receptacle elevator device 100 further comprises one or more accordion or telescoping extension members 106 around the midpoint of the housing, that are disposed with an axis which is perpendicular to the longitudinal axis of the housing. The accordion extension members 106 are used to increase the vertical height (or, depending on the orientation, the horizontal length) of the device 100 by extending each accordion member 106 as needed to reach the desired height of the device 100 above the existing electrical wall outlet. In this manner, the female receptacles 108, 110 and the USB receptacles 112, 114 are raised by extending the accordion members 106 so that the same can be accessed easier by an individual, particularly those individuals who cannot bend down or reach behind furniture to access the existing electrical wall outlet. Stated differently, the height of the original electrical wall outlet is increased by the use of the electrical receptacle device 100 of the present invention.

Figure 4:
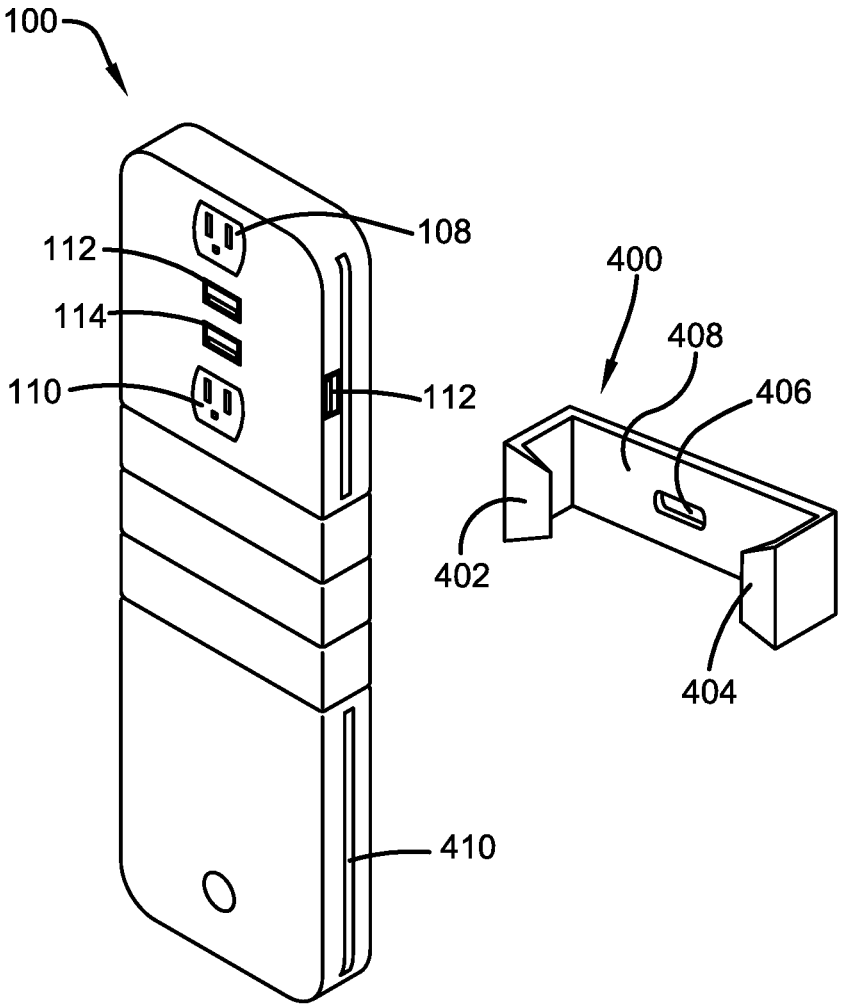
FIG. 4 illustrates a front perspective view of one potential embodiment of the electrical receptacle elevator device of the present invention in an extended position and away from its related wall mounting apparatus in accordance with the disclosed architecture.

A single source of power can be used to provide power to each receptacle present on the front surface 102 or other surface of the device 100, wherein the single source of electrical power is derived from the existing electrical wall outlet which is placed in electrical communication with the device 100. It should be appreciated that no wires, electrical extension cords and/or power links are necessary to use the electrical receptacle device 100, thereby making the same relatively lightweight and highly portable. Any type of in-wall female receptacle can be used on the front surface 102 during manufacturing to meet the various needs and/or preferences of the user. The electrical receptacle device 100 further comprises an internal connection bus 111 to provide power to the female 108, 110 and USB receptacles 112, 114, respectively. Further, the USB receptacles 112, 114 may be positioned on the side surfaces of the housing and separate from the electrical receptacles 108, 110, as best shown in FIG. 4. In this manner, the use of the USB ports 112 do not interfere with use of the electrical receptacles 108, 110.

A push button or switch 104 may be present on the front surface 102 of the device (or elsewhere) to activate the power supply from the female receptacles 108, 110 and/or the USB receptacles 112, 114. This also provides security for children who can accidentally touch the receptacles 108, 110, 112, 114 when the device 100 is plugged into a power source, such as an existing electrical wall outlet.

An AC to DC converter 116 may also be positioned within the device 100 to provide the correct amount of power to the USB receptacles 112, 114. The receptacles 108, 110, 112, 114 are preferably present on the upper side of the front surface 102 (i.e., above the plurality of accordion members 106) to raise the height of the receptacles 108, 110, 112, 114 considerably when the accordion members 106 are fully extended. As stated above, the USB ports 112, 114 may be positioned on the front surface 102 or the side surface 105 of the housing of the device 100 so as to avoid a user inadvertently plugging in one of the prongs of an electrical device into the USB port opening 112, 114, and to avoid the use of the USB ports 112, 114 from interfering with the use of the electrical receptacles 108, 110. The front surface 102 of the device 100 may further comprise one or more indicator lights 121, 123 to display the status of the current flowing through the device 100.

FIG. 2 illustrates a rear perspective view of one potential embodiment of the electrical receptacle elevator device 100 of the present invention in a normal or collapsed position in accordance with the disclosed architecture. The rear surface 202 of the device is preferably comprised of the same material as the front and side surfaces 102, 105, and has generally the same dimensions as the front surface 102. The accordion extension mechanism 106 is also present on the rear surface 202, such that the height of the various receptacles 108, 110, 112, 114 may be uniformly increased or decreased.

In order for the device 100 to receive power from an existing electrical wall outlet, the rear surface 202 has a male plug 204 that plugs into, and is in electrical communication with, the existing wall outlet. The male plug 204 can be a two-pin male plug or a three pin male plug having a ground. The male plug 204 is connected to the bus 111 within the housing of the electrical receptacle device 100, to provide power to the female receptacles 108, 110 and the USB receptacles or ports 112, 114 present on the front or side surfaces 102, 105 of the electrical receptacle device 100.

The male plug 204 provides reliable physical and electrical connection to the wall outlet and distributes uniform and consistent power to the female receptacles 108, 110 and the USB receptacles or ports 112, 114 present on the front or side surfaces 102, 105 of the electrical receptacle device 100. The male plug 204 may have brass pins, and is comprised of a rugged PVC body that resists moisture and/or chemicals. In one embodiment, the pins or blades of the male plug 204 can be securely placed within the housing for easy transportation and storage. More specifically, when not in use, the blades or pins of the male plug 204 can be repositioned into the housing through a hinged mechanism.

In one embodiment, the electrical receptacle elevator device 100 further comprises an outlet swivel head 206 that is capable of rotating up to 90 degrees, and that allows the housing to pivot about the periphery or exterior surface of the male plug 204. More specifically, an individual can utilize the swivel head 206 to rotate the electrical receptacle device 100 up to ninety degrees or any angular portion thereof, for example, when the individual wants to mount the electrical receptacle device 100 in a horizontal, as opposed to a vertical, position. This feature is particularly useful when the individual wants to have the female or USB receptacles 108, 110, 112, 114 closer to the user and not at a particular vertical height above the floor or the wall outlet. Further, the swivel head 206 may comprise a locking mechanism which prevents further movement or rotation of the housing once in the desired position.

Figure 3:
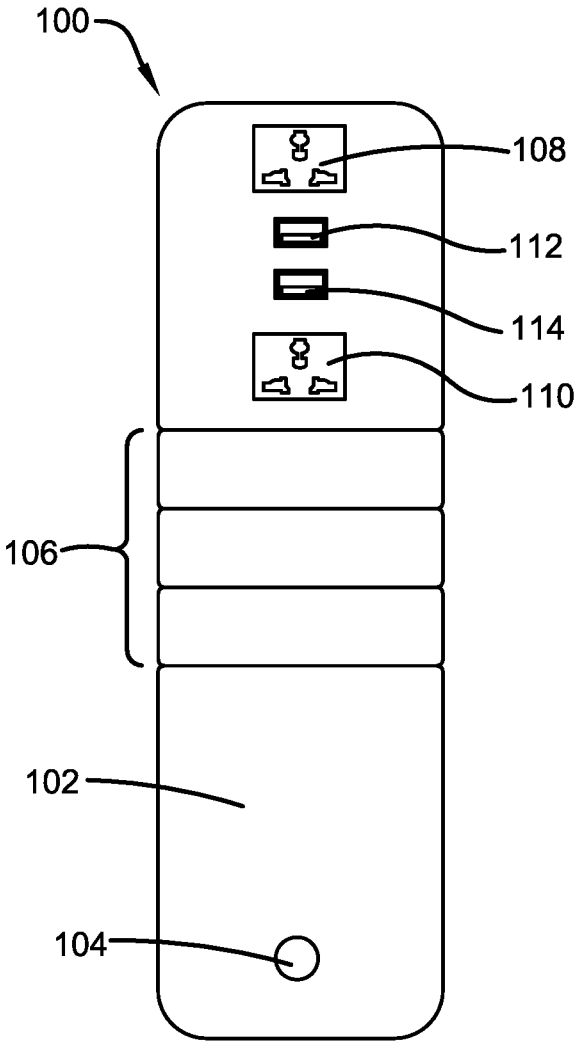
FIG. 3 illustrates a front perspective view of one potential embodiment of the electrical receptacle elevator device of the present invention in an extended position in accordance with the disclosed architecture.

FIG. 3 illustrates a front perspective view of one potential embodiment of the electrical receptacle elevator device 100 of the present invention in an extended position in accordance with the disclosed architecture. It should be noted that each accordion member 106 is movably interconnected to each subsequent and preceding accordion member 106, and that when a slight longitudinal force is applied thereto, the accordion members 106 unfold or stretch to increase the overall vertical height (or, depending on the orientation of the device 100, the length) of the receptacle extension device 100, and raise the female receptacles 108, 110 and USB receptacles or ports 112, 114 higher above the floor or the existing electrical wall outlet to which the same it attached. Any single accordion or telescoping member 106 may be used, or all of the members 106 may be extended to reach the desired height.

Using the accordion members 106 in a stretched form or condition, the receptacle extension device 100 virtually raises the height of the original wall outlet into which the male plug 204 present on the rear surface 202 of the receptacle extension device 100 is plugged. In a preferred embodiment the increase in height is approximately 18" to 24", but the device 100 of the present invention is not so limited, and other distances are also contemplated to suit user need and/or preference. Nonetheless, in the stretched or extended form, the female receptacles 108, 110 and USB receptacles 112, 114 can be more easily accessed by those individuals who cannot bend down or that are seeking to access electrical outlets that are behind furniture or some other obstruction. The ability to raise the effective height of the electrical outlets also enables the individual to place the same out of the immediate reach of small children.

In one embodiment, the accordion members 106 may be connected to one another by inbuilt torsion-bar spring bearings. Additionally, the plurality of accordion members 106 can be folded, extended or relaxed just by applying a gentle force to make the members 106 return to the unfolded or first position. The number of accordion or extension members 106 may vary depending on the requirement of the user in raising the female and USB receptacles 108, 110, 112, 114 to a desired vertical height, or an extended horizontal distance.

FIG. 4 illustrates a front perspective view of one potential embodiment of the electrical receptacle elevator device 100 of the present invention in an extended position and away from its related wall mounting apparatus 400 in accordance with the disclosed architecture. As shown, the device 100 may further comprise an anchor drywall mounting device 400 for mounting the electrical receptacle device 100 onto a wall or other structure. The mounting device 400 is comprised of a back plate 408 having a centralized hole 406 that may be used to mount the mounting device 400 to a wall using a fastener such as a nail or a screw. The mounting device 400 is preferably an integrally formed structure, having a first covering surface 402 and a second covering surface 404 for mating engagement with one of more grooves 410 present on the side surfaces 105 of the elevator device 100.

More specifically, the elevator device 100 has grooves 410 along its side surfaces 105 for receiving the first and second covering surfaces 402, 404 of the wall mounting apparatus 400, to removably secure the device 100 to the mounting device 400 attached to a wall or other surface. When engaged to the wall mounting device 400, the elevator or telescoping device 100 remains securely attached thereto and may be easily repositioned between the collapsed and extended or deployed positions without disturbing the connection, and without interrupting the electric communication between device 100 and the existing electrical wall outlet. More specifically, the female receptacles 108, 110 and the USB receptacles 112, 114 are still accessible to a user when the device 100 is mounted onto a wall using the wall mounting device 400. The wall mounting device 400 can be attached to the device 100 anywhere along its length, other than along the length of the accordion members 106.

Figure 5:
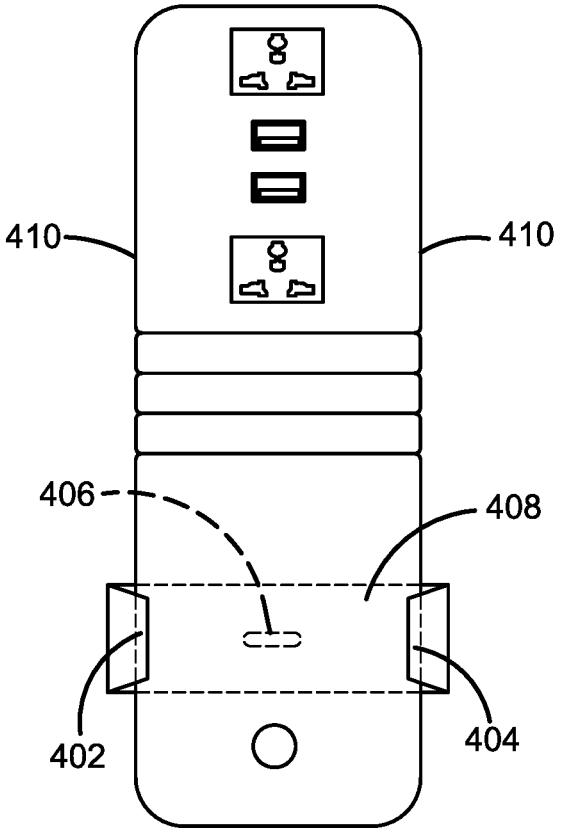
FIG. 5 illustrates a front perspective view of one potential embodiment of the electrical receptacle elevator device of the present invention in an extended position and removably attached to its related wall mounting apparatus in accordance with the disclosed architecture.

FIG. 5 illustrates a front perspective view of one potential embodiment of the electrical receptacle elevator device 100 of the present invention in an extended position and removably attached to the wall mounting apparatus 400 in accordance with the disclosed architecture. More specifically, the device 100 may be removably inserted into the wall mounting device 400 with the wall mounting device 400 screwed to a wall via a fastener that extends through opening 406. The rear surface 202 of the elevator device 100 touches the backplate 408 of the wall mounting device 400 when the elevator or telescoping device 100 is inserted within the body of the wall mounting device 400. The grooves 410 on the side surfaces of the device 100 frictionally engage with the wall mounting device 400 via the first and second surfaces 402, 404, wherein the first and second covering surfaces 402, 404 secure the elevator device 100 by covering and engaging with the grooves 410 and a portion of the front surface 102 of the device 100. It should also be appreciated that in this manner the electrical receptacle elevator device 100 will not fall off or detach when mounted onto a wall using the wall mounting device 400. More specifically, the frictional engagement of the grooves 410 and the front surface 102 with the body of the wall mounting device 400 removably secures the elevator device 100 thereto, until an individual applies outward pressure to the first and second members 402, 404 (i.e., laterally away from the device 100) to release the device 100 from the mount 400.

Figure 6:
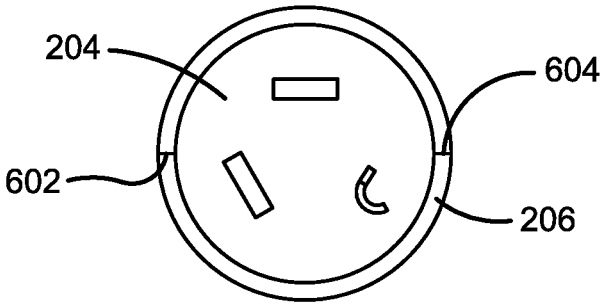
FIG. 6 illustrates a perspective view of one potential embodiment of the rotating swivel head around the male connector positioned at the rear surface of the electrical receptacle elevator device of the present invention in accordance with the disclosed architecture.

FIG. 6 illustrates a perspective view of one potential embodiment of the rotating swivel head 206 around the male connector 204 positioned at the rear surface 202 of the electrical receptacle elevator device 100 of the present invention in accordance with the disclosed architecture. As stated above, the male plug 204 may be comprised of two or three blades, pins or prongs and is permanently attached to the rear surface 202 of the device 100. Nonetheless, to rotate the device 100 to a horizontal (as opposed to vertical) direction once attached to an existing wall outlet, a ninety-degree outlet swivel head 206 is present around the male plug 204 which has a radial groove within the rear surface of the device 100. The radial groove rotates such that the pins 602, 604 allow the rotation of the radial groove up to ninety degrees in each of the clockwise and counter-clockwise directions. This flexibility allows the user to horizontally or angularly (as opposed to vertically) mount the device 100 relative to the existing electrical wall outlet.

Additionally, in a further embodiment, one or more of the female and/or USB receptacles 108, 110, 112, 114 may be constructed with a temporary cover, a permanent cover, a removable cover or a supplemental cover. Further, each of the receptacles 108, 110 on the front surface 102 may be for any single or multiple combination of voltage, amperage and/or power. Additionally, the male plug 204 may comprise blade or prong configurations that may be used in any country regardless of the electrical code or standard.

Figure 7:
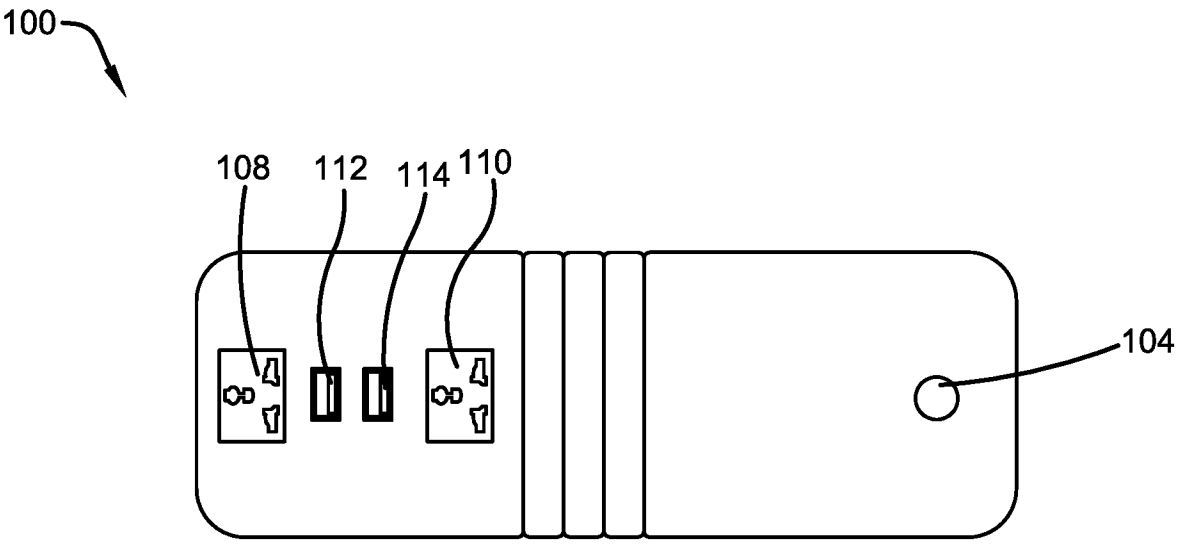
FIG. 7 illustrates a front perspective view of one potential embodiment of the electrical receptacle elevator device of the present invention in an extended and horizontal position in accordance with the disclosed architecture.

FIG. 7 illustrates a front perspective view of one potential embodiment of the electrical receptacle elevator device 100 of the present invention in an extended and horizontal position in accordance with the disclosed architecture. As shown, the electrical receptacle device 100 may be rotated up to ninety degrees in either a clockwise or counter-clockwise direction using the ninety degree outlet swivel head 206 present around the periphery of the male plug 204 at the rear surface 220 of the electrical receptacle device 100. Once the electrical receptacle device 100 is fully rotated ninety degrees in a clockwise or counter-clockwise direction, the electrical receptacle device 100 is mounted horizontally on the wall relative to the floor. This makes the female receptacles 108, 110, USB receptacles 112, 114 and power button 104 of the electrical receptacle device 100 more accessible all individuals, particularly when the exiting electrical wall outlet is obstructed by an object such as, but not limited to, furniture. Nonetheless, in other embodiments, the electrical receptacle device 100 can be rotated at different angles such as thirty degrees, forty-five degrees, sixty degrees or any other angle up to one hundred and eighty degrees (when considering that the device 100 can be rotated up to ninety degrees in either direction), to achieve an appropriate mounting position for the device 100.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "electrical receptacle elevator device", "receptacle elevator, telescoping device", "electrical receptacle device", "elevator or telescoping device" and "receptacle extension or extendable device" are interchangeable and refer to the telescoping electrical receptacle 100 of the present invention.

Notwithstanding the forgoing, the telescoping electrical receptacle 100 and its various components of the present invention can be of any suitable size and configuration as is known in the art without affecting the overall concept of the invention, provided that it accomplishes the above stated objectives. One of ordinary skill in the art will appreciate that the size, configuration and material of the telescoping electrical receptacle 100 as shown in the FIGS. are for illustrative purposes only, and that many other sizes and shapes of the telescoping electrical receptacle 100 are well within the scope of the present disclosure. Although the dimensions of the telescoping electrical receptacle 100 are important design parameters for user convenience, the telescoping electrical receptacle 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features, and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A telescoping wall outlet device comprising:

a telescoping housing having a front surface, a rear surface and a plurality of side surfaces;

at least one electric receptacle disposed in the front surface and at least one USB port disposed in one of the front or plurality of side surfaces;

a connector plug disposed on the rear surface and on an opposite end of the telescoping housing from at least one of the at least one of the electrical receptacle and the at least one USB port;

the connector plug having a radial groove, a first pin, and a second pin, wherein the first pin for limiting rotation of the telescoping housing up to ninety degrees in a clockwise direction and the second pin for limiting rotation of the telescoping housing up to ninety degrees in a counterclockwise direction where both the rotations relative to a vertical orientation of the telescoping housing; and wherein the telescoping housing having at least three accordion members.

2. The telescoping wall outlet device as recited in claim 1, wherein the at least three accordion members, when each is fully extended, extend the at least one electric receptacle between 18 to 24 inches away from the connector plug.

3. The telescoping wall outlet device as recited in claim 1 further comprising a wall mounting bracket removably secured to the telescoping housing.

4. The telescoping wall outlet device as recited in claim 3, wherein the wall mounting bracket is secured to the front and at least two of the plurality of side surfaces of the telescoping housing.

5. The telescoping wall outlet device as recited in claim 1, wherein the telescoping housing has a longitudinal axis and a transverse axis.

6. The telescoping wall outlet device as recited in claim 5, wherein the longitudinal axis has a length that is greater than a length of the transverse axis.

7. The telescoping wall outlet device as recited in claim 6 further comprising at least one indicator light for displaying a status of the telescoping wall outlet device.

8. The telescoping wall outlet device as recited in claim 7 further comprising a switch for providing power to the at least one electrical receptacle and the at least one USB port.

9. A telescoping outlet device comprising:

a telescoping housing having a front surface, a rear surface and a plurality of side surfaces, wherein a longitudinal length of the telescoping housing is always greater than a transverse width of the telescoping housing;

a plurality of telescoping members that, when extended, increase the longitudinal length of the telescoping housing;

a wall connector plug disposed on the rear surface of the telescoping housing;

a plurality of electrical receptacles disposed on the front surface of the telescoping housing; and a wall mounting bracket having two spaced apart arms for removable attachment to the telescoping housing, wherein the wall mounting bracket mountable to a wall and further wherein the telescoping housing repositionable between a first position and a second position when engaged to the wall mounting bracket.

10. The telescoping outlet device as recited in claim 9 further comprising a plurality of USB receptacles or ports disposed on at least one of the front surface or the plurality of side surfaces of the telescoping housing, wherein the wall connector plug is rotatable up to ninety degrees in a clockwise or counter-clockwise direction relative to the telescoping housing.

11. The telescoping outlet device as recited in claim 9, wherein the plurality of telescoping members are capable of repositioning the plurality of electrical receptacles from the first position to the second position.

12. The telescoping outlet device as recited in claim 11, wherein the first position is a non-extended position and the second position is an extended position.

13. The telescoping outlet device as recited in claim 12 further comprising at least one indicator light and at least one button.

14. The telescoping outlet device as recited in claim 13, wherein a distance between the first and second positions is about 18" to 24".

15. A telescoping outlet device comprising:

a telescoping housing having a front surface, a rear surface and a plurality of side surfaces;

a wall mounting bracket having two spaced apart arms for removable attachment to the telescoping housing, wherein the wall mounting bracket mountable to a wall and repositionable along a length of the telescoping housing;

a plurality of electrical receptacles provided in the front surface;

a wall connector plug provided on the rear surface, wherein the wall connector plug is inserted into, and in electrical communication with, an existing electrical wall outlet, and further wherein the wall connector plug is rotatable up to ninety degrees in either of a clockwise direction or a counter-clockwise direction relative to the telescoping housing;

at least one USB port provided in one of the front or plurality of side surfaces of the telescoping housing; and a button or switch to allow an electric current to be distributed from the existing electrical wall outlet to each of the plurality of electrical receptacles and the at least one USB port.

16. The telescoping outlet device as recited in claim 15 further comprising a plurality of accordion or telescoping members.

17. The telescoping outlet device as recited in claim 16, wherein the plurality of accordion or telescoping members, when fully extended, reposition the plurality of electrical receptacles from a first position to a second position, and further wherein the second position is approximately 18" to 24" away from the first position.

* * * * *